US006905358B2

(12) United States Patent
Wodok et al.

(10) Patent No.: US 6,905,358 B2
(45) Date of Patent: Jun. 14, 2005

(54) CONNECTOR WITH MISALIGNMENT COMPENSATION

(75) Inventors: Hans Joachim Wodok, Flein (DE); Andreas Christian Genesius, Heilbronn (DE)

(73) Assignee: Amphenol-Tuchel Electronics GmbH, Heilbronn (DE)

( * ) Notice: Subject to any disclaimer, the term of this patent is extended or adjusted under 35 U.S.C. 154(b) by 0 days.

(21) Appl. No.: 10/603,671

(22) Filed: Jun. 26, 2003

(65) Prior Publication Data

US 2004/0058581 A1 Mar. 25, 2004

(30) Foreign Application Priority Data

Jun. 28, 2002 (DE) ..... 102 28 950
Jul. 5, 2002 (DE) ..... 102 30 376

(51) Int. Cl.[7] ..... H01R 13/64
(52) U.S. Cl. ..... 439/381; 439/378
(58) Field of Search ..... 439/378, 380, 439/381, 374

(56) References Cited

U.S. PATENT DOCUMENTS 3,107,963 A * 10/1963 Hansen ..... 439/381
6,106,322 A * 8/2000 Navarrete et al. ..... 439/381

* cited by examiner

*Primary Examiner*—Renee Luebke
(74) *Attorney, Agent, or Firm*—Blank Rome LLP

(57) ABSTRACT

The invention relates to a connector comprising a first insulating body, and first contact elements supported by said first insulating body, said first insulating body comprising: at least one guiding or catching area having a perimeter defining and limiting said catching area, said catching area being adapted to assure that even for a certain amount of misalignment between said first connector and a second connector supporting second contact elements and adapted to be coupled to said first connector a proper engagement and connection of said first and second, contact elements occurs, thus forming a connector system due to the fact that said guide means provided on said second connector cooperate with said catching area, and guide said first and second connectors into engagement wherein the outer perimeter of said catching area has the shape of one of a square and a rectangle.

12 Claims, 5 Drawing Sheets

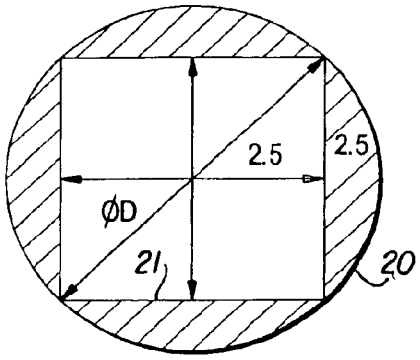
FIG. 1
(PRIOR ART)
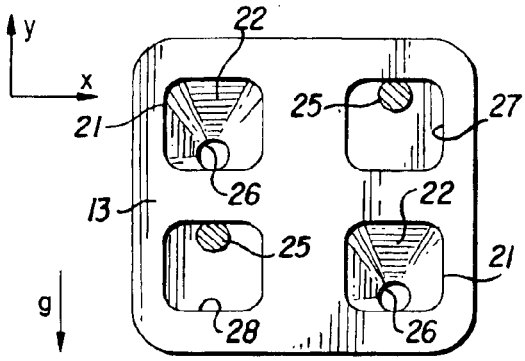
FIG. 2
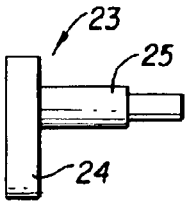
FIG. 2a
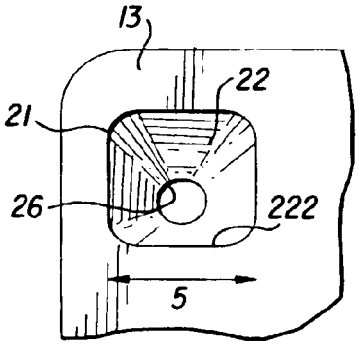
FIG. 4
FIG. 3
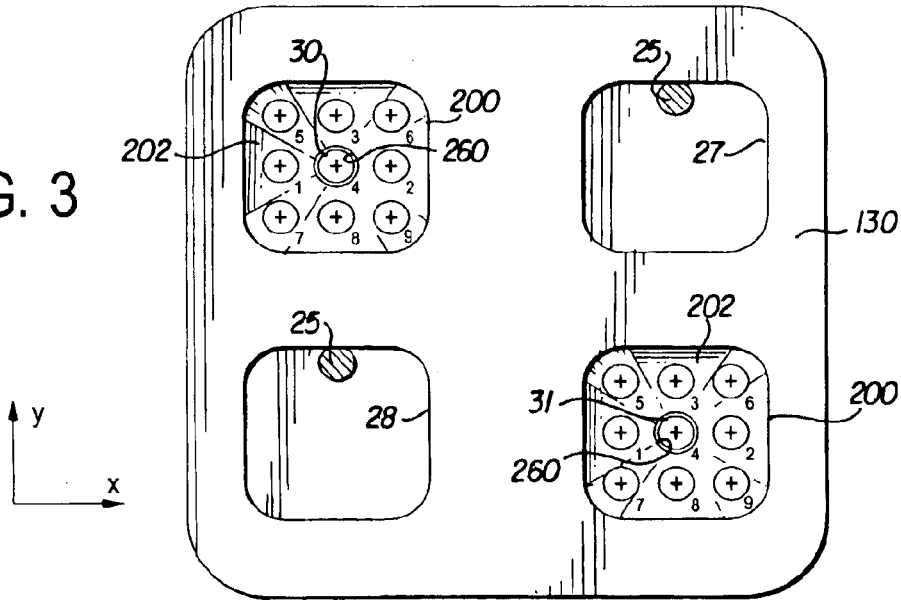

CONNECTOR WITH MISALIGNMENT COMPENSATION

TECHNICAL FIELD

The present invention relates to a connector, and in particular to a plug-in connector. The invention also relates to a connection system formed by two connectors.

BACKGROUND

Connectors are frequently used to provide electrical connections of all kinds. Plug-in connections formed by a first connector and a second connector in the form of a plug-in connector are frequently used in connection with switch cabinets Generally speaking, switch cabinets comprise a plurality of said first connectors which are mounted at a frame of a switch cabinet in a predetermined position defining a plug-in direction. Second connectors in the form of plug-in connectors are, for instance, provided at one or more drawer(s) which can be pushed into and out of the switch cabinet. The movement of a drawer into the switch cabinet provides for a plug-in motion of a second connector mounted on the drawer into a first connector mounted at the frame of the switch cabinet. The engagement of the first connector with the second, or plug-in, connector provides for a desired connection system.

Due to various reasons, during the operating life of said connectors, misalignments occur between the respective first and second connectors. In case such a misalignment occurs, the desired connection is either not possible, or is difficult to achieve. For this reason, plug-in connections were developed which are provided with circular catching regions which will provide, within certain tolerances, for proper plug-in connections at the time a drawer is moved into the frame of the switch cabinet.

However, the use of the circular catching areas requires a certain amount of space on the connectors which is consequently lost for other purposes.

SUMMARY OF THE INVENTION

In a first embodiment of the invention, a plug-in connection is provided using a first connector adapted to be mounted on a frame of a switch cabinet, and a second connector mounted on a drawer adapted to be pushed into and pulled out of said cabinet. According to the first embodiment of the present invention, one of the said first and second connectors is provided with a catch area of rectangular shape. According to a second embodiment of the invention, the catching area is of square shape.

In accordance with the invention, a catching area of ±2.5 mm can be realized using up a minimum of space.

In a further embodiment of the invention, a balance of the tolerances can be obtained in all directions by providing that a catching surface defining the catching area is asymmetrical, i.e. the catching surface defined by the catching area in the form of a conus, at the end of which, in plug-in direction, a catching hole is provided with the conus- or funnel-shaped catching surface being asymmetric, i.e. the catching hole being located close to the lower side of the catching area.

In a further embodiment of the invention, it is provided that the second, or plug-in, connector, is mounted movably with respect to the drawer, so as to provide for a stroke, allowing a relative translational movement between the second connector and the drawer. Due to the stroke length, the plug-in connection between the first and the second connectors will not be immediately released if the drawer is pulled out of the frame of the switch cabinet, but has to carry out first the stroke whereupon then the plug-in connection will be separated.

BRIEF DESCRIPTION OF THE DRAWINGS

FIG. 1 is a schematic view onto the guide or catching area of a first connector typically mounted at the frame of a switch cabinet.

FIG. 2 is a top plan view onto the connecting surface of a first connector having four catching areas according to the invention;

FIG. 2A is a side elevation view of a bolt used in the invention.

FIG. 3 is a view similar to FIG. 2, showing schematically the insertion of guide pins;

FIG. 4 is an enlarged view of the plug-in side of a second connector mounted in the frame and showing a square with a funnel- or cone-shaped surface having a guide hole at the bottom of the funnel;

DETAILED DESCRIPTION

Figure 5:
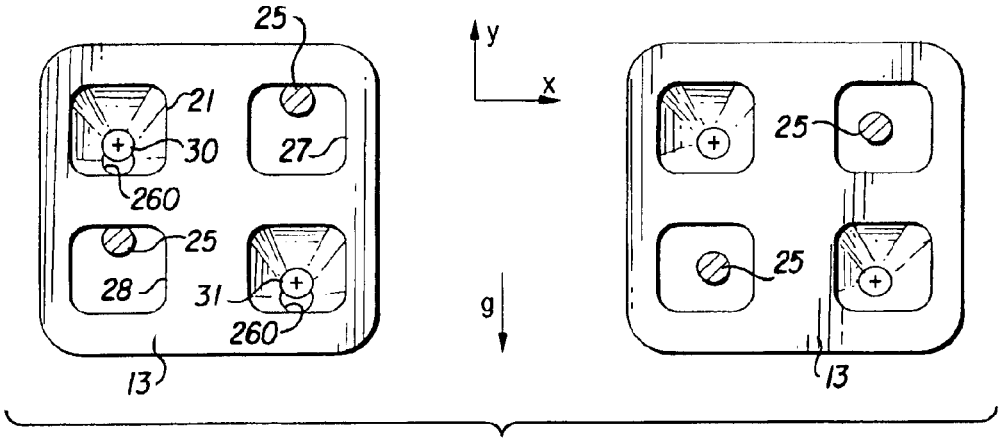
FIGS. 5–7 show schematically different guide or catching situations for the second connector.

Initially, reference will be made to FIGS. 12 and 14, which disclose a perspective view of a part 500 of a frame 8 of a switch cabinet, and also a part 600 of a drawer 9. The drawer 9 is adapted to be pushed into the switch cabinet. During this movement the drawer 9 is guided, by guide means which are not shown, but are provided between part 500 and part 600. A first, or frame, connector 11 in the form of a female connector is mounted to part 500 of the frame. For cooperation with the first connector 11, a second, or drawer, connector 12, in the form of a male connector, also called a plug-in connector, is mounted on part 600. The drawer connector 12 further cooperates with two guide pins 30 and 31, which are received in respective guide holes 731 and 732 (see FIGS. 10 and 11), provided by the drawer connector 12.

Figure 14:
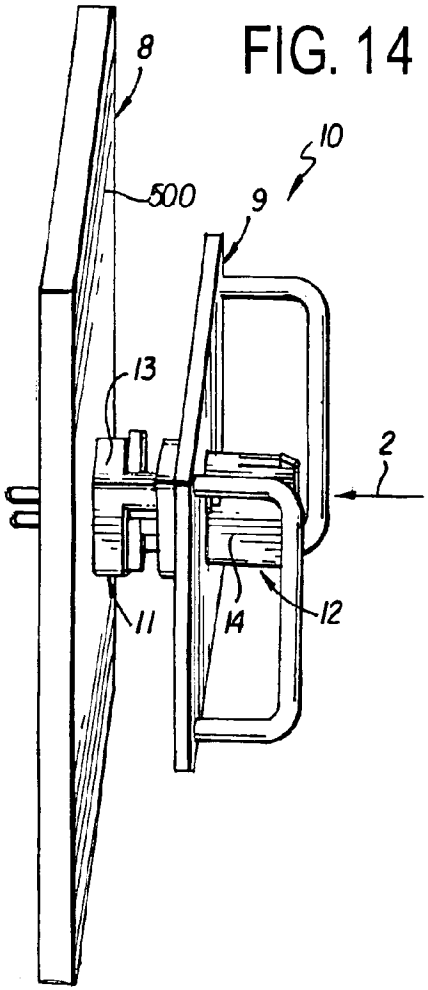
FIG. 14 discloses the plug-in connection system in its final position.

As shown in FIG. 14, a connection system 10 is formed by the frame connector 11 and the drawer connector 12, after the drawer connector 12 has been fully inserted into the frame connector 11.

The frame connector 11 is movably mounted at the frame part 500 for movement in a plane perpendicularly with respect to the plug-in and pull-out (short: plug) direction, indicated by arrow 2 in FIG. 14. The drawer connector 12 is translationally movably mounted within and relative to drawer part 600 of the drawer 9, in said plug direction 2, i.e. the drawer connector 12 is reciprocally moveably mounted in part 600, but is not movable perpendicularly to the plug direction 2.

The frame connector 11 comprises a first insulating body 13 adapted to receive contact elements which are not shown. The first insulating body 13 will be referred to below as female, or simply as a frame insulating body 13, inasmuch as in the preferred embodiment shown and described, the frame connector 11 carries female contact elements. The drawer connector 12 comprises a second insulating body 14, which will be referred to below as a male, or simply as a drawer insulating body 14, because in the shown preferred embodiment, the drawer connector 12 uses male contact elements. It is clear for the person skilled in the art that the design of the connection or connection system 10 could be different, i.e. the frame connector 11 could be designed as a male connector and the drawer connector 12 could be designed as a female connector.

Following this introductory note concerning the environment within which the invention is used, attention is now drawn to FIG. 1, which schematically discloses a top plan view of a catching, or guiding, area 20 provided on e.g. a frame insulating body. The catching area 20 is required for the following reasons. When establishing a plug-in connection like connection 10 between a first, or frame, connector and a second, or drawer, connector, it is necessary to properly align both connectors, so that the respective female contact elements and male contact elements achieve proper engagement. To a certain degree, the prior art as represented by FIG. 1, obtains with the circular catching area 20 some guidance for achieving said connection.

Assuming (see FIG. 1) that at the frame connector a catching area of ±2.5 mm in x and y directions had to be realized, for the full tolerance in x and y direction, the circle 20, forming the outer perimeter of the catching area 20, would have to be so large that the guide pins provided at the drawer connector would still be caught by the catching area 20 of the frame connector. If the prior art, for instance, provides, as shown in FIG. 1, a circular catching area 20 with the diameter of 5 mm, then no tolerance of ±2.5 mm in x and y direction is admissible. For an area of tolerance of ±2.5 mm in x and y direction, a circle is required which has a significantly larger diameter D than 5 mm. The consequence is that otherwise useful space is lost on the frame insulating body. By providing, in accordance with the invention, a rectangular or square catching area 21, a catching area of ±2.5 mm can be realized with the least possible amount of space being lost.

FIG. 2 is a top plan view of a frame insulating body 13, according to a preferred embodiment of the invention, which comprises a substantially square catching area 21, at the bottom end of which guide holes 26 are shown. FIG. 2 shows further the influence of gravity. As can be seen the frame insulating body 13 is adapted to be floatingly supported at frame part 500 (not shown in FIG. 2). The frame insulating body 13 is supported on bolts 23, which are threadedly connected with the frame part 500. As can be seen in FIG. 2A, each of the two bolts 23 used in the embodiment shown in FIG. 2 comprises a head 24 and a support section 25, on which the frame insulating body 13 rests. The bolt 23 also has a threaded end by means of which bolt 23 is fixedly connected to the part 500 of the frame.

Both FIGS. 2 and 4, the latter of which shows an enlarged portion of FIG. 2, disclose a tapered guide or catching surface 22 (also called funnel- or cone-shaped) leading to a guide and receiving hole 26, adapted to receive one of said guide pins 30, 31.

FIG. 3 discloses, in accordance with an embodiment of the invention, a frame insulating body 130, having a rectangular catching area 202 without the asymmetric design of the catching surfaces 22 of the catching area 21, as shown in FIG. 2. FIG. 3, like FIG. 2, discloses that the frame insulating body 130 is provided with cutouts 27 and 28, allowing for a certain movement of the frame insulating body 13 in a plane perpendicular to plug direction 2. Within the cutouts 27 and 28, each one bolt 23 is located, of which only the support section 25 is shown. The catching surfaces 202, defining the catching area 200, extend symmetrically into the plane of the drawing towards a guide and receiving hole 260 for one of the guide pins 30, 31, provided on the drawer.

As is shown in FIG. 3, there are nine positions referred to by numbers 1–9, which represent positions which the guide pin 30, and in a preferred embodiment the two guide pins 30, 31, can assume when the drawer 9 is moved into the switch cabinet. These nine positions show different positions of misalignment. For the positions 1–6 of the guide pins 30, 31, an alignment will be possible at the time the pins 30, 31, reach the catching area 200. For the positions 7–9, an alignment is not possible, inasmuch as this would require a downward movement of the frame insulating body 130, so that the arriving guide pins 30, 31 could enter the guide holes 260. A movement of the frame insulating body 130 downward is not possible because the frame insulating body 130 is already in abutment with the upper sides of the areas of movement defined by the cut outs 27, 28, which abut at the support sections 25 of the bolts 23.

To overcome the disadvantage of the just-described embodiment of the invention, the preferred embodiment is provided in FIGS. 2 and 4. An asymmetric catching or guide surface 22, also called an asymmetric catching funnel or cone, which is provided by the frame insulating body 13, in which the catching holes 26 are located adjacent to the lower perimeter section 222 of the catching area (see FIG. 4).

Figure 6:
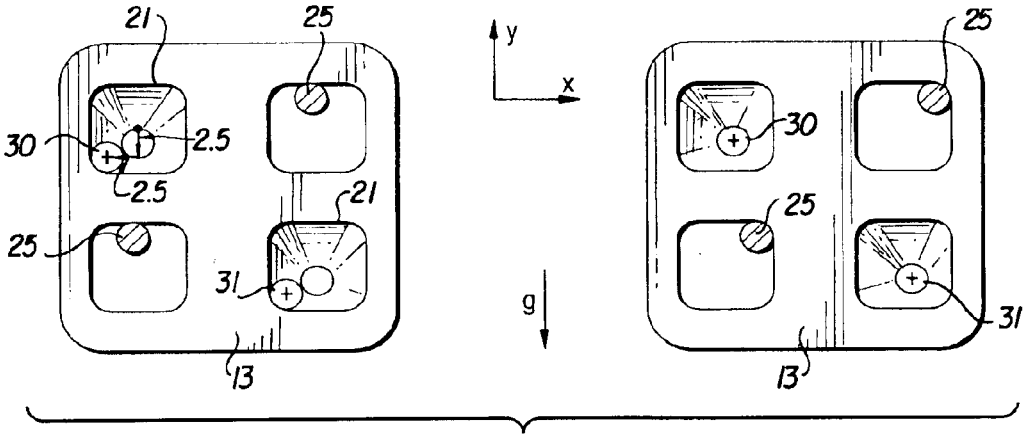
Figure 7:
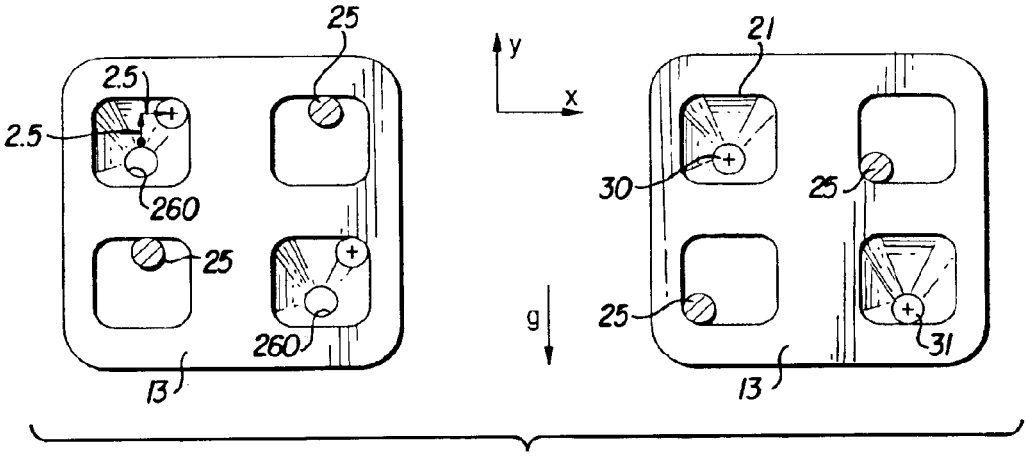

Each of FIGS. 5–7 disclose in each of the respective left sketches a frame insulating body 13 located in a center position. In case a drawer, together with a drawer connector, represented here only by the two guide pins 30, 31, is moved towards said frame insulating body 13, depending on the kind of misalignment, different "catching positions" are shown in the right-hand sketches of FIGS. 5–7. These FIGS. 5–7 disclose in the right-hand sketches some of the relative positions of the frame insulating body 13, with respect to the support section 25 of each of said bolts 23.

Figure 8:
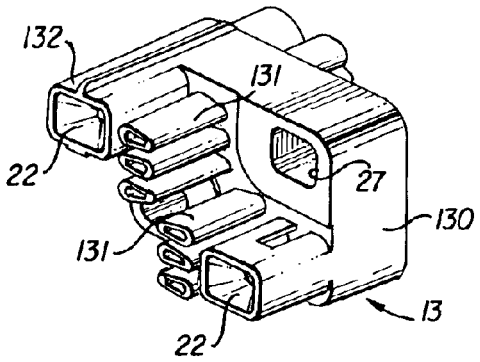
FIG. 8 shows a perspective view of a connector body of a first, female connector adapted to be mounted on the frame of a switch cabinet.
Figure 9:
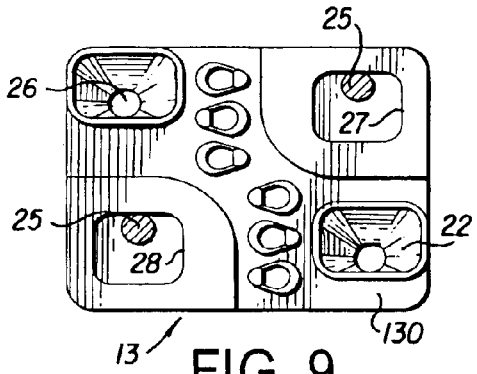
FIG. 9 is a top plan view of the connector FIG. 8.

FIGS. 8 and 9 are, respectively, perspective and top plan views of the frame insulating body 13. The frame insulating body 13 comprises a base section 130 in which the cutouts 27 and 28 are provided. The cutouts 27, 28 are preferably square-shaped and adapted to receive, as is shown in FIG. 9, the bolts 23, of which the support section 25 is schematically shown.

Projecting perpendicularly away from the base section 130, as is shown in FIG. 8, tube-shaped elements 131 are provided which are adapted to receive preferably female contact elements. Further, approximately square-shaped elements 132 are formed diagonally opposite to each other at the base section 130, forming in their free end the catching surfaces 22 of asymmetrical design, as was explained in connection with FIG. 4. The catching surfaces 22 end in catching holes 26.

Figure 10:
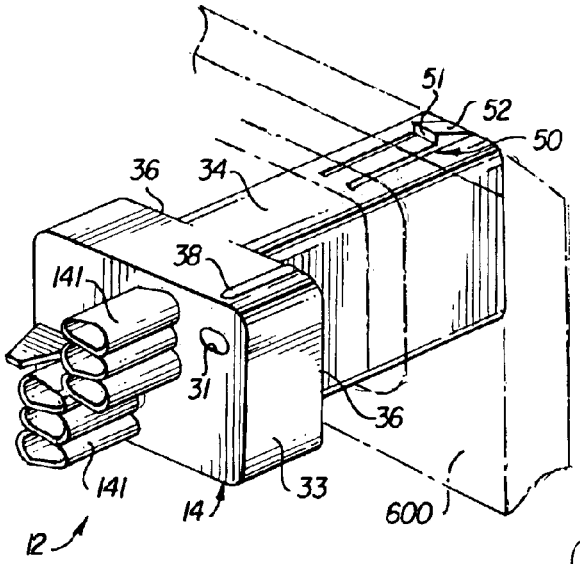
FIG. 10 is a perspective schematic representation of a second connector, also called a plug-in connector, which is adapted to be mounted on a drawer, a part of which is shown schematically.
Figure 11:
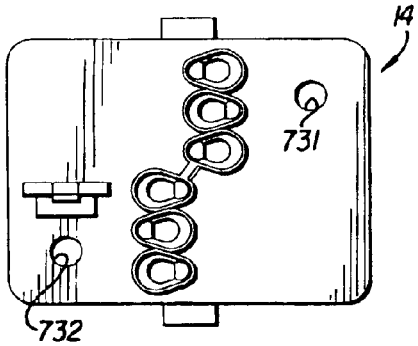
FIG. 11 is a top plan view of the connector of FIG. 10.
Figure 13:
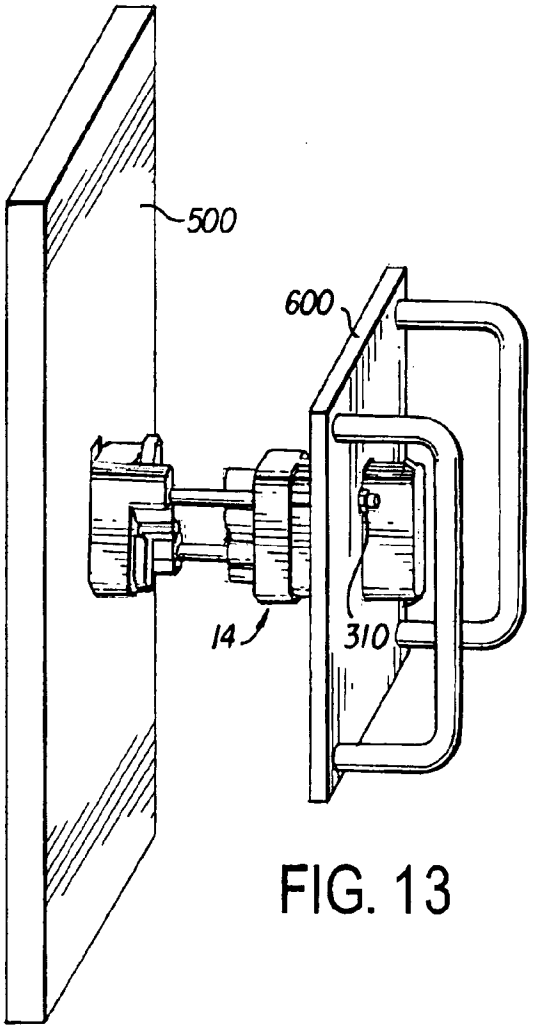
FIG. 13 discloses the partial insertion of the second, male connector in the first, female connector.
Figure 12:
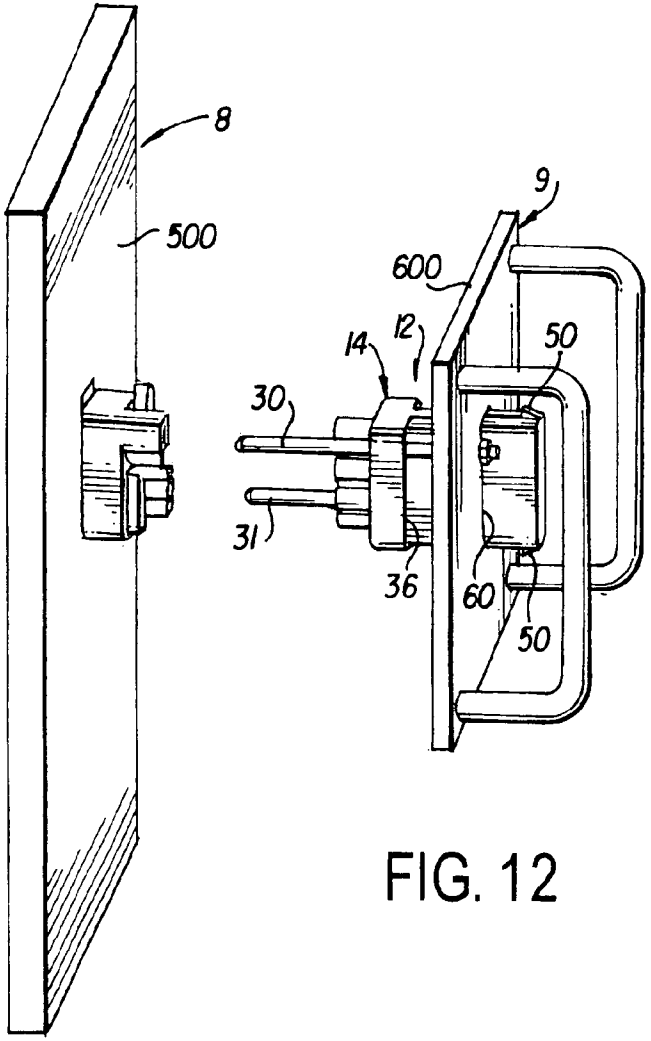
FIG. 12 shows a part of a frame of a switch cabinet with a first, female, connector mounted thereon, and with a second, male, or plug-in, connector slidably mounted on a part of a drawer.

FIGS. 10 and 11 disclose the drawer insulating body 14 which also comprises tube-shaped elements 141 adapted to receive male contact elements, i.e. contact pins, not shown. The tube-shaped elements 141 extend perpendicularly from a surface of a substantially square-shaped surface of a base section 33 from which a support section 34 projects away in the opposite direction. In the base section 33 of the drawer insulating body 14, the guide pin holes 731, 732 are provided which extend through the base section 140 in plug-in direction 2, as referred to in FIG. 14. The support section 34 has a substantially rectangular cross-section and has the form of a parallelepiped. It is located about centrally at the base or head section 33. The head section 33 defines adjacent to the location where the support section 34 extends from the head section 33 abutment surfaces 36. The upper surface of the head section 33 is provided with an arrow 38 of orientation.

Figure 16:
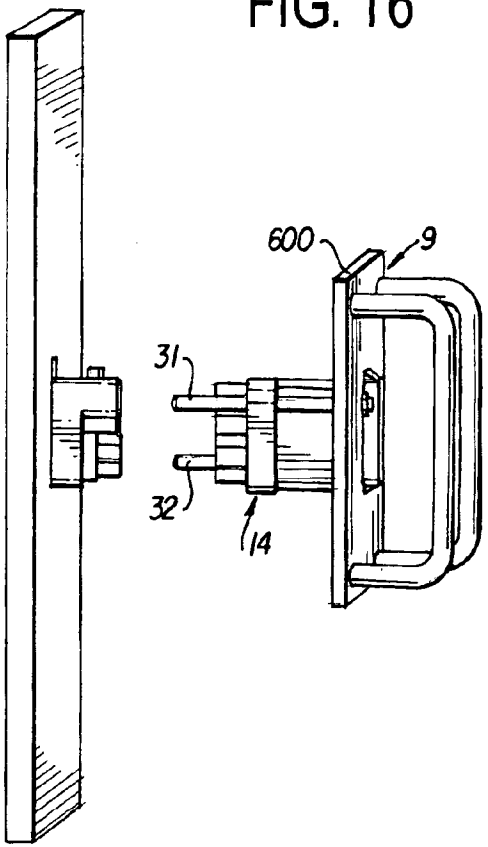
FIG. 16 shows the female connector and the male connector not forming a plug-in connection system anymore.
Figure 15:
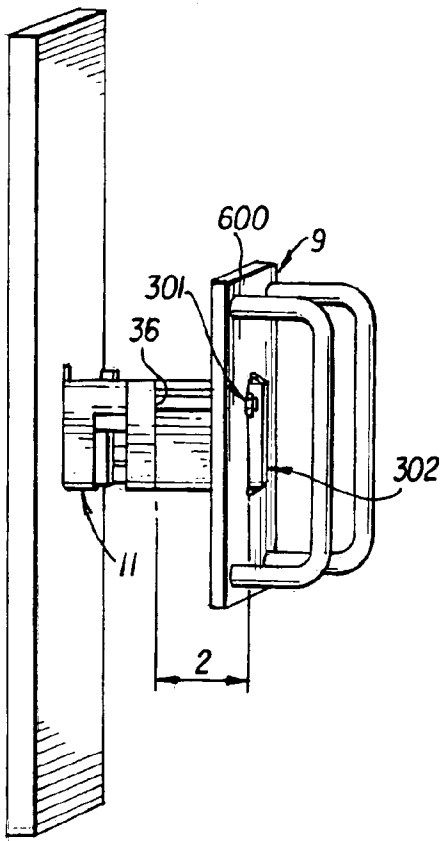
FIG. 15 discloses the first stage of removal of the second, or plug-in, connector from the female connector with the part of the drawer having moved the complete length of a stroke, so that a continued movement of the part of the drawer would remove the second, or plug-in, connector from the first, or female, connector as it is shown in FIG. 16.

FIG. 10 discloses, as do FIGS. 12–16, that the support section 34 of the drawer insulating body 14 has a predetermined length which provides for a certain amount of stroke length L, as shown in FIG. 15. One end of the stroke length L is defined by resilient detent hooks 50. Preferably, as shown in FIG. 16, the resilient detent hooks 50 are located diametrically opposite to each other, i.e. on the upper and lower right-hand corners of the free end. (FIG. 10) of the support section 34. The resilient detent hooks 50 make it possible for the drawer to be placed on the support section 34, or stated differently, the support section 34 can be inserted in a respective rectangular hole 60 (FIG. 12) provided in the drawer part 600. This placement process is simplified by detent guide surfaces 52, which are inclined and cause the detent hooks 50 to resiliently move inwardly during the insert operation of the support section 34 into the hole 60 of the part 600 of the drawer. The shape of the opening 60 corresponds to the shape of the support section 34 to readily receive said support section 34, allowing for a relative movement between the support section 34 and part 600, as is shown in FIGS. 12–16.

As is shown, for instance in FIG. 16, the part 600 of drawer 9 is provided with the two earlier-mentioned guide pins 30, 31 in the following manner. The guide pins 30, 31 are mounted at part 600 of the drawer 9, by means of nuts 310 (only one is shown). The guide pins 30, 31 project through the openings 731, 732 in the base section 33 of the drawer insulating body 14 and extend out of said openings 731, 732 as is shown in FIG. 12. By means of said guide pins 30, 31, which project away from the drawer insulating body 14 in plug-in direction 2, provided the misalignment between the drawer insulating body 14 and the frame insulating body 13 is not too great, alignment can be achieved. The free ends of the guide pins 30, 31 will engage within the asymmetric catching area 22, i.e. the catching surface and will move, if no perfect alignment is present, the frame insulating body 13 in the same manner as shown in FIGS. 5–7.

A continued translational movement of the drawer (a part of which is shown at 600) towards the part 500 of frame 8 of the switching cabinet will eventually lead to an engagement between the female contacting elements of the frame connector 11 and the male contact elements of the drawer connector 12, as is shown in FIG. 14. This engagement will be caused by the pushing force of the operator imparted upon the handles at the drawer 9 to the drawer connector 12 by the interaction of the part 600 of the drawer 9 coming into engagement with the abutment surfaces 36 of the drawer connector 12.

So as to make it possible that the drawer 9 can be moved by a certain amount out of the contact position shown in FIG. 14, however without opening the plug connection between the frame connector 11 and the drawer connector 12, the drawer insulating body 14 is provided with said parallelepiped-shaped section 34, having detent hooks 50. The length of said support section 34, together with the position of the detent hooks 50, define the possible stroke length L, which is available when withdrawing the drawer 9 from the position shown in FIG. 14.

The opening or unplugging of the plug-in connection 10 can occur after the defined stroke length L has been traveled. After the defined stroke, the drawer insulating body 14 will be pulled out of the frame insulating body 13, thus opening the connection between the female and male contact elements in the respective insulating bodies. Prior art designs, however, require numerous individual components and a costly assembly process, which will lead to expensive connectors.

By the integration of the detent hooks 50 in the plastic material forming the drawer insulating body 14, it is possible to provide for the stroke length L without additional components. During assembly, the drawer insulating body 14 is inserted with its free end through the hole 60 into the part 600 of the drawer, such that the detent hooks 50 are depressed and then spring back into their original position, thus mounting the drawer insulating body 14 on the part 600 of the drawer 9.

As referred to above, the two guide pins 30, 31 are inserted into the guide holes 731, 732 of the support section 34 and the ends of the guide pins opposite to the free ends, or plug-in ends are mounted at the drawer 9, preferably by a thread connection as shown in FIG. 15. For this purpose, the ends of the guide pins 30, 31 which extend to corresponding holes in the drawer 9 are provided with threads, onto which the nuts 310 are screwed, to fixedly mount the guide pins 30, 31 at drawer 9, as shown at 301 and 302 in FIG. 15. Thus, the drawer insulating body can reciprocate on the guide pins 30, 31. The relative translational movement between support section 34 and part 600 is limited on the one hand side by the abutment surfaces 36 and on the other hand side by abutments 51 formed by the detent hooks 50. As is shown, the detent hooks 50 have a spring arm which extends in longitudinal, or plug-in direction. At the free end of the spring arm, a detent nose is provided which forms the detent guide surface 52 and the abutment surface 51.

What is claim is:

1. A connector comprising a first connector having a first insulating body, a second connector having a second insulating body, first contact elements supported by said first insulating body, and second contact elements supported by said second insulating body adapted to be coupled to said first connector, said first insulating body including:

at least one catching area having a perimeter defining and limiting said catching area, said catching area being adapted to assure even for a certain amount of misalignment between said first connector and said second connector, that a proper engagement and connection between said first and second contact elements occurs, thus forming a connector system due to guide means provided on said second connector cooperating with said catching area, and guiding said first and second connectors into engagement, and said second insulating body including a base portion from which a support section projects with a free end into one direction, defining abutment surfaces on the base portion.

2. The connector of claim 1 wherein the catching area is defined by said insulating body of said first connector with a recess extending into said insulating body from said perimeter of said catching area, such that a catching surface provided by the surface of said recess extends inwardly from said perimeter towards a receiving hole at an inner end of said catching surface.

3. The connector of claim 2, wherein said receiving hole, located at the inner end of said catching surface is located close to a lower portion of the perimeter of the catching area and in a middle portion thereof.

4. The connector of claim 3, wherein at each of two diametrically oppositely located corners of the first insulating body, cutouts are provided which are adapted to receive mounting means when said first connector is movably mounted on a component.

5. A connector of claim 1 wherein said support section has a predetermined length so as to provide for a stroke length which allows for a relative translational movement between the second insulating body and a part of a drawer on which said second connector is mounted, said stroke length being limited by said abutment surfaces and by an abutment surface, provided close to said free end of said support section, and wherein said abutment surface is provided by a detent hook, formed adjacent to the free end of said support section.

6. The connector of claim 1, wherein said base portion is provided with guide pin holes at diagonally opposite positions, said guide holes extending in directions parallel to the direction of extension of the support section.

7. A connector of claim 1, wherein the outer perimeter of the catching area has the shape of one of a square and a rectangle.

8. A connector system comprising:

a first connector and a second connector, said first connector having a first insulating body and first contact elements supported by said insulating body, said first insulating body comprising at least one catching area having a perimeter defining and limiting said catching area, said second connector comprising a second insulating body and second contact elements supported by said second insulating body, said second insulating body having a base portion, from which a support section projects with a free end of said support section into one direction, said second connector having guide means associated therewith which are adapted to cooperate with said catching area, said catching area being adapted to assure that even in the case of a certain amount of misalignment between said first connector and said second connector, both will be coupled properly by connecting said first and second contact elements of said first and second connectors, due to said guide means provided on said second connector cooperating with said catching area and guiding said first and second connectors into engagement, wherein the outer perimeter of said catching area has the shape of one of a square and a rectangle.

9. A connector system comprising:

a first connector having a first insulating body and first contact elements supported by said insulating body, said first insulating body including at least one catching area with a perimeter defining and limiting said catching area; and a second connector having a second insulating body, second contact elements supported by said second insulating body, and guide means associated therewith separate from said second contact elements, which are adapted to cooperate with said catching area, whereby said catching area assures proper engagement of the first and second connectors, even when said first and said second connectors are misaligned, by connecting said first and second contact elements of said first and second connectors, and said guide means of said second connector cooperating with said catching area and guiding said first and second connectors into engagement.

10. The connector system of claim 9, wherein the outer perimeter of said catching area has the shape of one of a square and a rectangle.

11. The connector system of claim 9, wherein said first and second connectors are mounted on first and second supports, respectively; and said first and second connectors being moveable with respect to said first and second supports.

12. The connector system of claim 9, wherein said guide means are pins extending from said second connector.

* * * * *

UNITED STATES PATENT AND TRADEMARK OFFICE

CERTIFICATE OF CORRECTION

PATENT NO. : 6,905,358 B2
DATED : June 14, 2005
INVENTOR(S) : Hans Joachim Wodok et al.

It is certified that error appears in the above-identified patent and that said Letters Patent is hereby corrected as shown below:

Title page,
Item [57], ABSTRACT, change to read as follows:

-- A connector that includes a first connector with a first insulating body, and first contact elements supported by the first insulating body. The first insulating body has at least one catching area having a perimeter defining and limiting the catching area. The catching area is adapted to assure that even for a certain amount of misalignment between the first connector and a second connector supporting second contact elements and adapted to be coupled to the first connector a proper engagement and connection of the first and second contact elements occurs. A connector system is formed due to a guide provided on the second connector cooperating with the catching area, and guiding the first and second connectors into engagement. The outer perimeter of the catching area can have the shape of one of a square and a rectangle. --.

Signed and Sealed this

Twenty-fifth Day of April, 2006

JON W. DUDAS
*Director of the United States Patent and Trademark Office*